US005298948A

United States Patent [19]

Kurisu

[11] Patent Number: 5,298,948

[45] Date of Patent: Mar. 29, 1994

[54] DEVELOPING DEVICE IN AN IMAGE FORMING APPARATUS

[75] Inventor: Toshiyuki Kurisu, Kanagawa, Japan

[73] Assignee: Kabushiki Kaisha Toshiba, Kawasaki, Japan

[21] Appl. No.: 871,296

[22] Filed: Apr. 20, 1992

[30] Foreign Application Priority Data

Apr. 26, 1991 [JP] Japan ..... 3-096607

[51] Int. Cl.[5] ..... G03G 15/06; G03G 21/00

[52] U.S. Cl. ..... 355/245

[58] Field of Search ..... 355/245, 251, 259, 210

[56] References Cited

U.S. PATENT DOCUMENTS

| | | | |
|---|---|---|---|
| 4,835,565 | 5/1989 | Nagatsuna et al. | 355/259 |
| 4,891,674 | 1/1990 | Seyfried | 355/245 |
| 4,951,093 | 8/1990 | Ishii et al. | 355/245 |
| 4,989,037 | 1/1991 | Nagatsuna | 355/259 X |
| 5,070,366 | 12/1991 | Tsuchiya | 355/219 |

FOREIGN PATENT DOCUMENTS 1-93774 4/1989 Japan .

*Primary Examiner*—Fred L. Braun
*Attorney, Agent, or Firm*—Limbach & Limbach

[57] ABSTRACT

A developing device includes a developing roller for applying a developing agent to an electrostatic latent image on an image carrier. The developing roller is movable between a first position where the developing roller faces the image carrier through a gap therebetween and a second position where the developing roller is separated from the first position. The developing device further includes a positioning member associated with the developing roller for making the gap uniform along the longitudinal direction of the developing roller at the first position to allow the applying of the developing agent to the image carrier, a first urging mechanism having a first urging force for urging the developing roller to move from the first position to the second position, and a second urging mechanism responsive to the rotation of the developing roller and having a second urging force greater than the first urging force for urging the developing roller to move from the second position to the first position.

7 Claims, 4 Drawing Sheets

DEVELOPING DEVICE IN AN IMAGE FORMING APPARATUS

BACKGROUND OF THE INVENTION

1. Field of the Invention

The present invention relates to a developing device in an image forming apparatus, which develop an electrostatic latent image on a photosensitive body by a developing roller.

2. Description of the Related Art

In conventional image forming apparatus such as an electrophotographic copying machine, a magnetic brush developing device is used. The magnetic brush developing device develops the electrostatic latent image on the photosensitive body using a magnetic brush with uniform tufts formed on a developing roller. The developing roller comprises a magnet and a cylindrical sleeve. Alternatively, such apparatus used a developing device which developed the electrostatic latent image by a non-magnetic one-component developing agent which electrostatically adhered to a non-magnetic developing roller. In order to obtain a developed image with a constant density, cylindrical gap rollers were provided on both sides of the developing roller as described in Japanese Laid-Open Patent (Kokai) No. HI-93774. The gap between the surface of the photosensitive body and the developing roller was kept uniform by pressing these gap rollers on the non-image formation region of the photosensitive body.

In the conventional image forming apparatus, the gap rollers for maintaining a uniform gap between the surface of the photosensitive body and the surface of the developing roller were pressed under constant load on the non-image formation regions of the photosensitive body by springs or by the weight of the developing device itself. For this reason, highly accurate gap rollers were required for obtaining an image with stable and uniform density. Despite this, and although the gap rollers were not easily distorted and used materials with minimum distortion, because of the construction, the gap rollers were liable to undergo uneven loads in the stationary state during non-developing operation, which resulted in distortion. Thus, there was the problem of the occurrence of density randomness due to the distortion of the gap rollers, leading to a great reduction of picture quality. At the same time, when the developing device was installed against the photosensitive body, if the pressure of the gap rollers on the photosensitive body was too great, this pressure caused a resistance which interfered with rotation of the photosensitive body during the developing operation, leading to randomness in the rotation of the photosensitive body. Therefore there was also the problem a great reduction of picture quality due to image blurring.

SUMMARY OF THE INVENTION

It is an object of the present invention to provide a developing device in an image forming apparatus, in which the gap rollers are not distorted and thus make the image density uniform by separating the gap rollers from the photosensitive body during non-developing operations, and only pressing the gap rollers on the photosensitive body during the developing operation.

According to the present invention there is provided a developing device including roller means for applying a developing agent to an electrostatic latent image on an image carrier, the roller means movable between a first position where the roller means faces the image carrier through a gap therebetween and a second position where the roller means is separated from the first position, the device comprising a positioning member associated with the roller means for making the gap uniformly along the longitudinal direction of the roller means at the first position to allow the applying of the developing agent to the image carrier; first urging means having a first urging force for urging the roller means to move thereof from the first position to the second position; and second urging means responsive to the rotation of the roller means and having a second urging force greater than the first urging force for urging the roller means to move thereof from the second position to the first position.

DETAILED DESCRIPTION OF THE PREFERRED EMBODIMENT

Referring to the accompanying drawings, a detailed description will subsequently be given of the preferred embodiment of the present invention.

Figure 1:
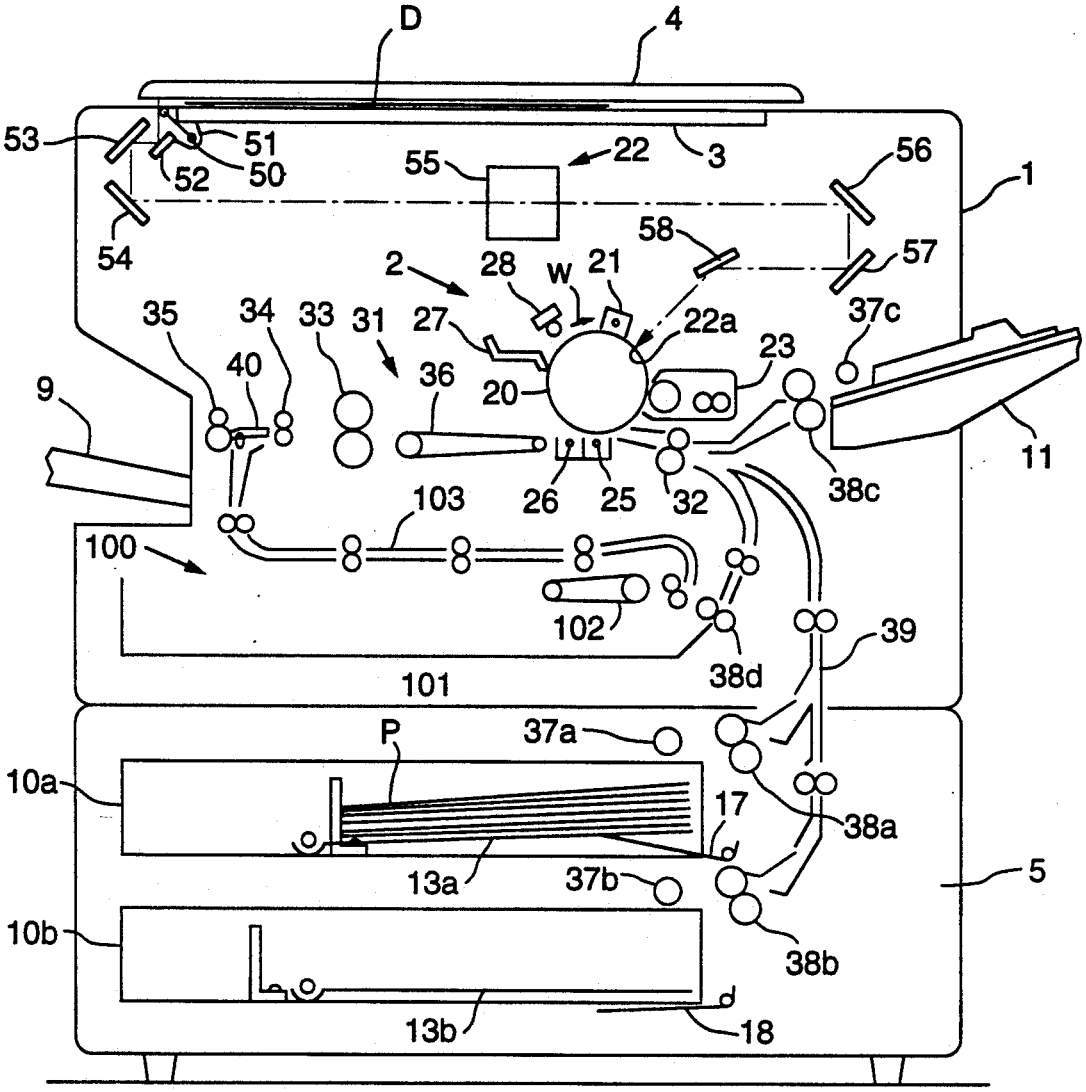
FIG. 1 is a sectional view showing an image forming apparatus in which a developing device according to the present invent is accomodated.

FIG. 1 shows an internal construction of the image forming apparatus. Image forming unit 2, which performs charging, exposure, developing, transferring, separating, cleaning, discharging and fixing, is housed inside main body 1. Original document table 3, on which original document D is placed, is provided on the upper surface of main body 1. Original document cover 4 is attached to original document table 3 to cover original document D on table 3.

Automatic two sides device 100, which reverses paper conveyed from image forming unit 2 during forming images on both sides of the paper, is provided in the lower part of main body 1. In the lower part of main body 1, paper supply unit 5 is also arranged. First and second paper supply cassettes 10*a* and 10*b*, which store paper P, are contained in paper supply unit 5. Paper P is supplied to image forming unit 2 from one of the first and second paper supply cassettes 10*a* and 10*b*. Paper supply tray 11 for the manual supply of paper P to main body 1 is attached to the righthand side of main body 1.

Drum-shaped photosensitive body 20 as an image carrier is arranged almost centrally inside main body 1. Main charger 21, exposing station 22*a* of exposure device 22, developing device 23, transfer charger 25, separation charger 26, cleaning unit 27 and discharger 28, which are well-known from prior art, are arranged in that order in the direction of rotation around the periphery of photosensitive body 20.

Paper conveying path 31 is formed inside main body 1. This paper conveying path 31 conducts paper P via photosensitive body 20 to receiving tray 9 provided on the left-hand side of main body 1. Paper P is supplied from first and second paper supply cassettes 10*a* and 10*b* which support paper P on trays 13*a* and 13*b* which are pushed upward by arms 17 and 18 during supply of the paper stored in paper supply unit 5, or from paper supply tray 11, or alternatively from automatic two sides device 100.

Aligning roller pair 32 is arranged in paper conveying path 31 on the up-stream side of photosensitive body 20. Aligning roller pair 32 acts to align the leading edge of paper P and convey the paper in synchronization with photosensitive body 20. Fixing roller 33, conveyor roller pair 34 and exit roller pair 35 are arranged on the downstream side. Gate 40 is arranged between conveyor roller 34 and exit roller pair 35. Gate 40 acts to distribute paper P, conveyed from conveyor roller pair 34, either to the exit roller pair 35 side or to the automatic two sides device 100. Conveyor belt 36 is arranged between separation charger 26 and fixing roller 33.

First to third pick-up rollers 37*a* to 37*c* are provided in the vicinity of the paper supply cassettes 10*a* and 10*b* and paper supply tray 11. Paper P taken out by the respective pick-up rollers 37*a* to 37*c* is conveyed into paper conveying path 31 via first to third separation conveying rollers 38*a* to 38*c*.

Fourth pick-up roller 102 and fourth separation conveying roller 38*d* are arranged on the paper extraction side of automatic two sides device 100. Reversal conveying path 103 conveys paper P, which has been diverted to the automatic two sides device 100 by gate 40, to paper stack portion 101.

Exposure device 22 comprises exposure lamp 51, reflector 50, first to sixth mirrors 52 to 54 and 56 to 58 and lens 55. Exposure lamp 51 illuminates original document D placed on original document table 3. The light image reflected from the original document is led via first mirror 52, second mirror 53 and third mirror 54 in that order to lens 55. Then, the light image transmitted through lens 55 is led to photosensitive body 20 via fourth mirror 56, fifth mirror 57 and sixth mirror 58 in that order.

Figure 2:
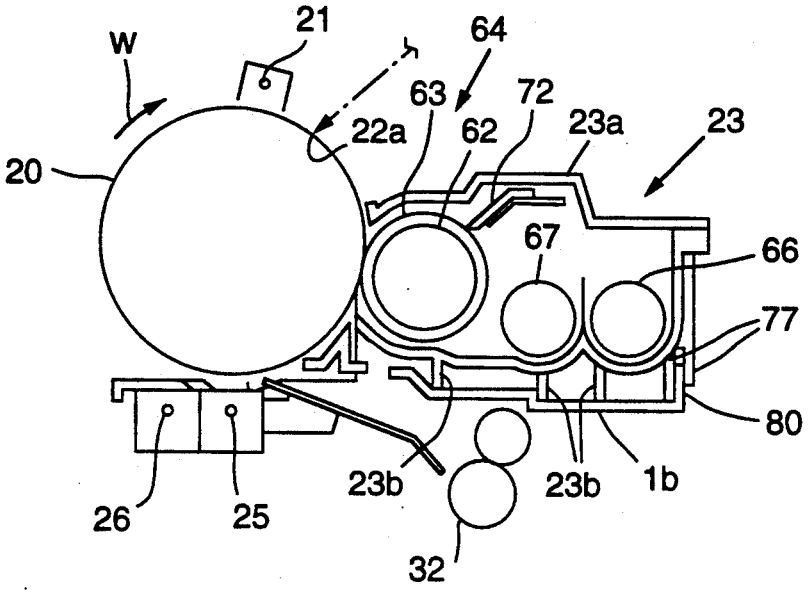
FIG. 2 is a sectional view showing the developing device of the sent invention.
Figure 3:
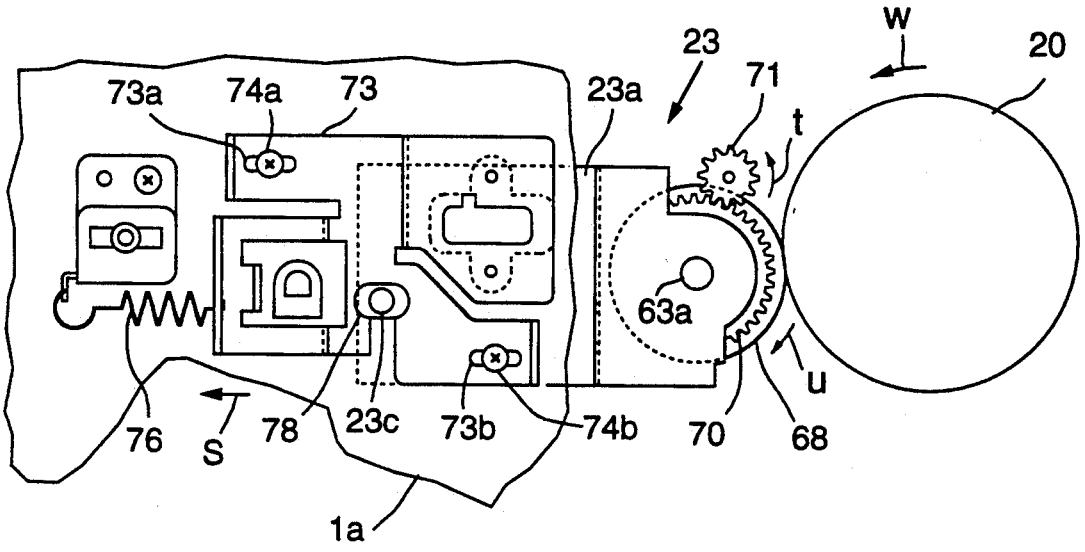
FIG. 3 is a side view of the developing device seen from the rear when installed in the main body of the apparatus.
Figure 4:
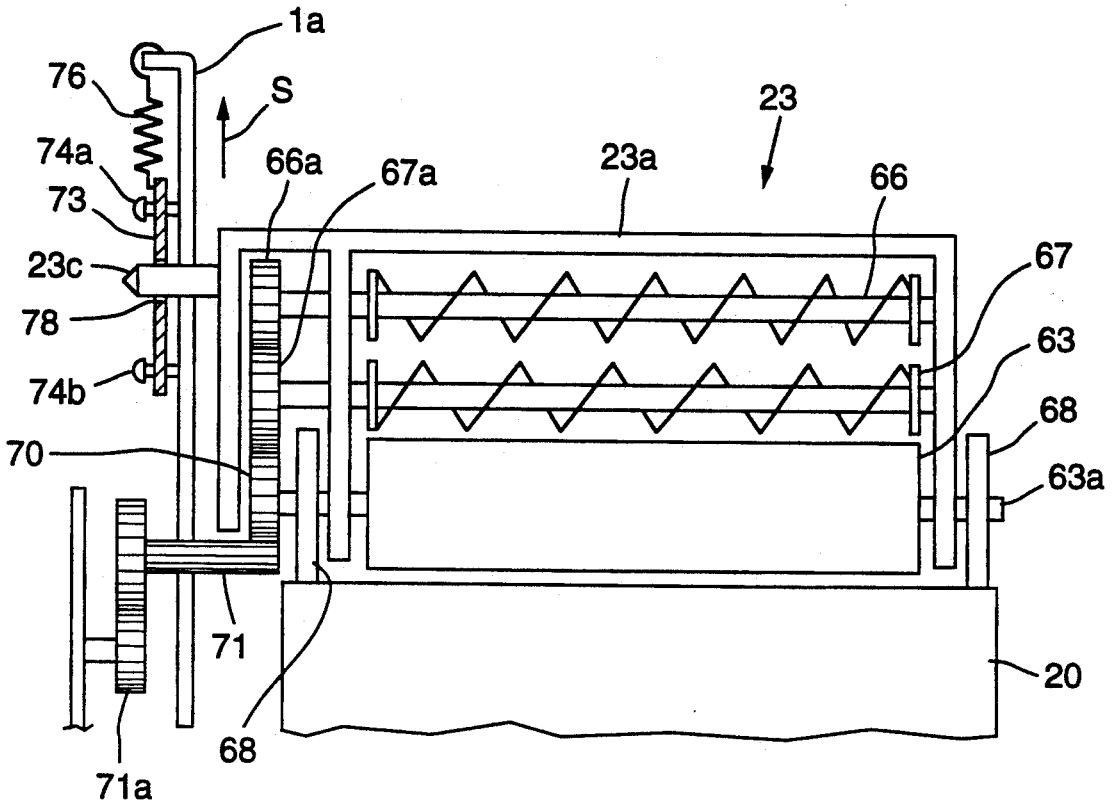
FIG. 4 is a transverse sectional view of the developing device when the developing device is installed in the main body the apparatus.
Figure 5:
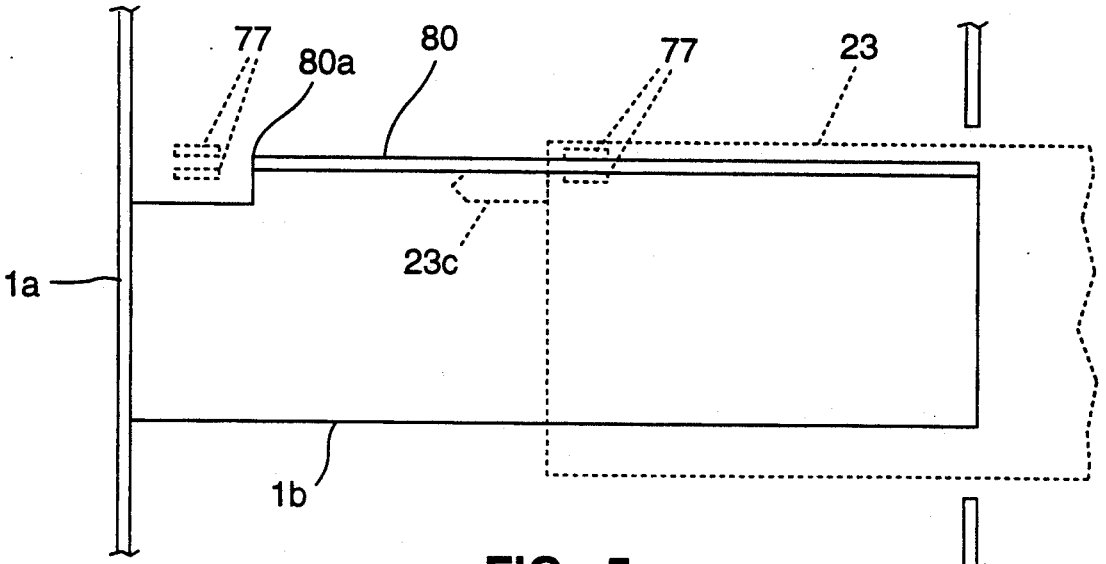
FIG. 5 is a schematic view showing the insertion and removal of the developing device along the guide rail.

Developing device 23 will now be described in detail. As shown in FIGS. 2 and 3, developing device 23 is located facing photosensitive body 20 at the developing station. Developing roller 64 is arranged in the opening of casing 23*a* of developing device 23. Developing roller 64 comprises a magnet 62 and non-magnetic cylindrical sleeve 63 of 30 [mm] diameter and made of aluminium which surrounds the periphery of magnet 62. Cylindrical sleeve 63 is designed so that a magnetic brush composed of developing agent is formed on its periphery by its rotation. First mixer 66, which transports and agitates toner which is replenished from a toner hopper (not shown), and second mixer 67, which agitates the developing agent composed of toner and carrier particles inside casing 23*a*, are disposed inside casing 23*a*. Gap rollers 68 of diameter 32 [mm] as the positioning members are mounted on the both ends of shaft 63*a* of cylindrical sleeve 63. These gap rollers 68 maintain a gap of 1 [mm] between photosensitive body 20 and cylindrical sleeve 63 when gap rollers 68 are pressed on photosensitive body 20. Gear 70 is mounted on the axis of shaft 63*a* for driving cylindrical sleeve 63 and mixers 66 and 67 which interlock with this sleeve. Gear 70 is rotated by engaging with driving gear 71 which transmits the driving force from the drive source (not shown) of main body 1. Leveller 72 faces cylindrical sleeve 63 with a gap between them in order to control the height of the tufts of the magnetic brush on the periphery of developing roller 64. As shown in FIG. 4, second mixer gear 67*a* is attached to one end of second mixer 67 and engaged to sleeve gear 70. First mixer gear 66*a* is attached to one end of first mixer 66 and engaged to second mixer gear 67*a*. When sleeve gear 70 is rotated by driving gear 71, second mixer 67 and first mixer 66 are rotated via second mixer gear 67*a* and first mixer gear 66*a*.

Grease is coated on slide-plate section 23*b* of the bottom surface of casing 23*a* to make it capable of sliding easily in main body 1. Casing 23*a* is mounted on sliding member 73, which is the supporting device, and is made capable of sliding on main frame 1*a* when casing 23*a* is installed in main body 1. That is, sliding member 73 is mounted on main frame 1*a* by first and second pins 74*a* and 74*b* which pass through first and second slots 73*a* and 73*b* so that sliding member 73 can slide. Normally, sliding member 73 is urged by coil spring 76 in the direction in which sliding member 73 is separated from photosensitive body 20 by approximately 1.4 [kg]. Guide rail 80 is formed on bottom frame 1*b* of main body 1. This guide rail 80 is inserted between a pair of rail holders 77 which are formed on the bottom surface of casing 23*a* so that guide rail 80 guides developing device 23 to insert to main body 1 and remove from main body 1. The rear end portion 80*a* of guide rail 80 is left open and, in this position, rail holders 77 disengage from guide rail 80 so that rail holders 77 become free. Thus, developing device 23 becomes capable of sliding between the first position, in which the developing operation is performed, and the second position, in which developing roller 64 is separated from photosensitive body 20. Developing device 23 is guided on guide rail 80, and its installation in main body 1 is completed by passing rigid shaft 23*c*, which is formed on its rear side, through bearing 78 of sliding member 73. Guide rail 80 is set in a position such that, while guide rail 80 is engaged with rail holders 77 through developing device 23 being inserted into or withdrawn from main body 1, there is a gap of approximately 3 [mm] between gap rollers 68 and photosensitive body 20. Driving gear 71 is set so that, when developing device 23 is installed in main body 1, driving gear 71 engages with sleeve gear 70 in a position which is offset by a central angle of 10 [°] from the vertical direction of sleeve gear 70.

The operation of developing device 23 will now be described. In the non-developing operations before the start of copying operation, slide member 73 is pulled in the arrow s direction by the urging force of coil spring 76. Developing device 23 is also pulled via rigid shaft 23*c*, which passes through bearing 78, in the arrow s direction, which is the direction of separation from photosensitive body 20. Therefore, a gap of approximately 3 [mm] is maintained from photosensitive body 20 without gap rollers 68 of developing device 23 being pressed on photosensitive body 20.

When copying operation commences, original document D is placed on original document table 3. Then, first, the copying conditions, such as number of copies, copy magnification, paper size and image density, are set by operator keys on the operation panel (not shown), and the 'Copy' button is switched ON. By this means, the copying operation is commenced, and image forming unit 2 starts the image forming operation. Photosensitive body 20 is rotated in the arrow w direction by a driving mechanism which is not shown. After photosensitive body 20 has been charged by main charger 21, photosensitive body 20 is exposed by exposure device 22 and an electrostatic latent image is formed on photosensitive body 20. Photosensitive body 20 then arrives at the developing station in which the surface of photosensitive body 20 is faced by developing device 23.

Figure 6:
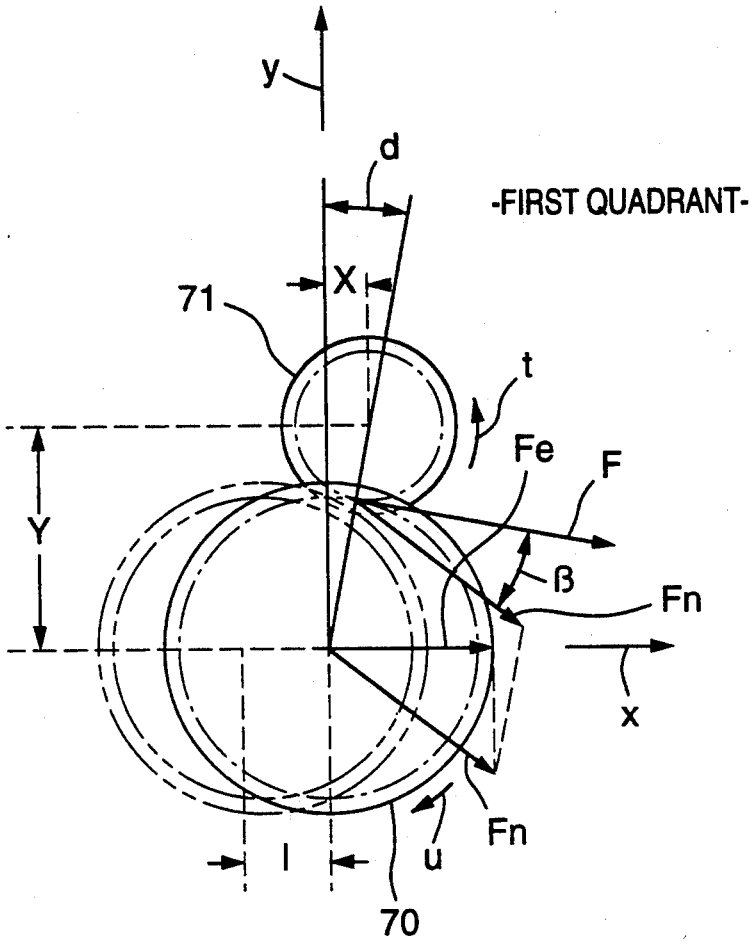
FIG. 6 is an illustration of the forces generated in the gear by the rotation of the driving gear used in the developing device.

As shown in FIG. 6, in developing device 23, driving gear 71 is rotated in the arrow t direction under the driving force from the drive source (not shown) of main body 1, and driving force Fn is transmitted to the faces of the teeth of gear 70 by this means. This driving force Fn has as its component forces the driving torque which rotates cylindrical sleeve 63 in the arrow u direction and, at the same time, the urging force Fe in the x direction which urges developing device 23 in the arrow x direction, which is the photosensitive body 20 direction. That is, by rotating cylindrical sleeve 63 in the arrow u direction under the driving torque, a magnetic brush is formed on the periphery of cylindrical sleeve 63 and developing is made possible. On the other hand, gear 70 is urged in the x direction by urging force Fe against the urging force of coil spring 76. Therefore, cylindrical sleeve 63 and developing device 23 which supports cylindrical sleeve 63 are made to slide toward photosensitive body 20. Thus, gap rollers 68, which are separated approximately 3 [mm] from photosensitive body 20 during non-developing operations, are pressed on photosensitive body 20. By this means, the gap between the surface of photosensitive body 20 and the surface of cylindrical sleeve 63 is maintained at approximately 1 [mm]along their whole length in the longitudinal direction. Here, when driving gear 71 is rotating, and before cylindrical sleeve 63 rotates, the driving torque is set greater than the x direction urging force so that the sliding of developing device 23 is accurately carried out.

Driving force Fn occurring on the faces of the teeth of gear 70 and the urging force Fe in the x direction are expressed by Equations (1) and (2).

$$Fn = F \cdot \tan \beta \quad (1)$$

$$Fe = Fn \cdot \cos(\alpha + \beta) = F \cdot \tan\beta \cdot \cos(\alpha + \beta) \quad (2)$$

Here, F is the tangential load on the two gears 70 and 71, and $\beta$ is the pressure angle of the two gears 70 and 71. In this embodiment, $\beta = 20$[°].

Also, $\alpha$ shows the positional relationship of the two gears 70 and 71. It is the angle formed by the line joining the centers of the two gears 70 and 71 and the vertical line of gear 70, and is expressed by Equation (3). In this embodiment, $\alpha = 10$[°].

$$\alpha = \tan^{-1}\left(\frac{X}{Y}\right) \quad (3)$$

Here, X is the distance between the centers of the two gears 70 and 71 in the x direction, and Y is the distance between the centers of the two gears 70 and 71 in the y direction.

In this embodiment in which driving gear 71 is rotated in the arrow t direction, in First Quadrant in FIG. 6, a is taken to have limits of 0 to 45 [°] in order not to interfere with the sliding of developing device 23 toward the photosensitive body.

Moreover, when the sliding distance of developing device 23 is taken as l and the module of the two gears 70 and 71 is taken as m, the relationship in Equation (4) can be obtained.

$$\sqrt{\{(X + l)^2 + Y^2\} - (X^2 + Y^2)} < 2m \quad (4)$$

In equation (4), $2m$ represents the height of the teeth of gears 70 and 71.

In developing device 23 of this embodiment, as obtained from Equation (5), when the urging force Fe in the x direction became approximately 2.5 [kg], this urging force Fe could slide developing roller 64 to the first position, in which developing is carried out by resisting coil spring 76 and pressing gap rollers 68 on photosensitive body 20.

$$Fe = 7.9 \cdot \tan 20^\circ \times \cos(10^\circ + 20^\circ) \simeq 2.5[kg] \quad (5)$$

Here, the tangential load F of the two gears is 7.9 [kg].

The electrostatic latent image formed on photosensitive body 20 is developed by the magnetic brush formed on the surface of developing roller 64. During this developing operation is performed, the surface of developing roller 64 is maintained with a gap between it and the surface of photosensitive body 20 of approximately 1 [mm] by gap roller 68 being pressed on photosensitive body 20. Then photosensitive body 20 arrives at the transfer station. During this time, paper P is taken out from paper supply cassettes 10*a* and 10*b* or from paper supply tray 11 and is conveyed to separation conveying rollers 38*a* to 38*d*. Paper P is temporarily stopped at the position of aligning roller pair 32, and is then conveyed between photosensitive body 20 and transfer charger 25 in synchronisation with the developing agent image on photosensitive body 20. Thus, transferring operation is performed. After this, paper P is peeled from photosensitive body 20 by separation charger 26. Paper P is then conveyed by conveyor belt 36, and is fixed by being conveyed to fixing roller 33. In the case of single-side copying, paper P is dispensed toward receiving tray 9 by gate 40. After completion of transferring operation, photosensitive body 20 is made ready for the next copy by passing cleaning unit 27 and discharger 28. This type of copying operation is repeated by image forming unit 2 until the entire copying operation is completed after obtaining the required number of copies.

The drive source of main body I is stopped by the completion of the copying operation. When driving gear 71 stops, the rotation of gear 70 and cylindrical sleeve 63 are stopped. At the same time, the urging force Fe, which urges developing device 23 in the x direction toward photosensitive body 20, becomes 0. Developing device 23 is made to slide in the arrow s direction (shown in FIG. 3) by the urging force of coil spring 76. Thus, gap rollers 68 are separated from photosensitive body 20 and developing roller 64 is also made to slide to the second position, which is separated from photosensitive body 20.

In the state in which driving gear 71 is stopped during non-developing operations, developing device 23 is urged toward the second position in which developing device 23 is separated from photosensitive body 20 by the urging force of coil spring 76, and gap rollers 68 are separated from photosensitive body 20. On the other hand, during the developing operation, gap rollers 68 are pressed on photosensitive body 20 by the urging force Fe generated by the rotation of driving gear 71. Developing roller 64 slides to the position in which the developing is performed, and the gap between photosensitive body 20 and developing roller 64 can be made uniform over its whole length in the longitudinal direction. Thus, no distortion occurs in gap rollers 68, as was the case in prior art, and a good image with uniform image density can be obtained. Thus, the reliability of the apparatus is improved. Also, when developing device 23 is inserted in or removed from main body 1 during maintenance, gap rollers 68 are separated by a distance of approximately 3 [mm] from photosensitive body 20 and, furthermore, the developing device is guided by guide rail 80. Thus, there is no risk of damaging photosensitive body 20 by gap rollers 68 touching photosensitive body 20 by mistake, and the reliability of the apparatus is improved. Moreover, the drive device for sliding developing device 23 from the second position to the first position also performs the rotation of driving gear 71 for rotating cylindrical sleeve 63. For this reason, there is no requirement to provide a dedicated device for shifting developing device 23. Thus, there is nothing to cause increases in cost and space. Furthermore, developing device 23 is constantly urged in the direction of separation from photosensitive body 20 by coil spring 76. For this reason, there is no risk of the occurrence of randomness of rotation caused by excessive pressure of gap rollers 68 on photosensitive body 20 during the developing operation preventing the smooth rotation of photosensitive body 20. Thus, image blurring due to randomness in the rotation of photosensitive body 20 can be prevented. Therefore the image quality is improved and consequently the reliability of the system is improved.

The present invention is not limited to the above embodiment, and modifications are possible within the true spirit and scope of the present invention. That is, the urging device may be installed in any position, provided urging device urges the developing device, which is capable of sliding within the main body, toward the second position in which the developing device is separated from the image carrier during non-developing operations, and, at the same time, urges the developing roller at the first position, in which the developing operation is executed, by an urging force toward the image carrier generated by the rotation of the driving gear during the developing operation.

Moreover, the image carrier and the driving gear may rotate in any direction, and also the driving gear may engage with the gear in any position provided this does not interfere with the sliding of the developing device. For instance, when the angle a of developing device 23 in the embodiment is varied within the limits of 0 to 45 [°], from Equation (2), the urging force Fe in the x direction becomes as shown in Table 1. Here, the tangential load of the gear is taken as 7.9 [kg].

TABLE 1

| $\alpha$ [°] | Fe [kg] |
|---|---|
| 0 | 2.7 |
| 10 | 2.5 |
| 20 | 2.2 |
| 30 | 1.8 |
| 40 | 1.4 |
| 45 | 1.2 |

From these results, theoretically $\alpha$ does not interfere with the sliding of developing device 23 toward photosensitive body 20 up to 45 [°]. However, when a is over 40 [°], the urging force of coil spring 76 becomes greater than urging force Fe in the x direction. Thus, developing device 23 cannot slide toward photosensitive body 20.

Also, the gap between the image carrier and the cylindrical sleeve during non-developing operations may be of any width, provided the gap is within limits in which the developing device is capable of sliding.

Furthermore, the driving torque of the developing roller may be of any size. However, if the urging force required for sliding the developing device is greater than the urging force for rotating the developing roller, the developing device will not be able to slide, despite the rotation of the developing roller. Therefore, the driving torque of the developing roller and the urging force which slides the developing device are set so that driving torque expressed by Equation (6).

$$\text{Driving Torque} > [F \cdot \tan\beta \cdot \cos(\alpha+\beta)] \quad (6)$$

The developing roller is not limited to a developing roller in a magnetic brush device. It may also be a non-magnetic sleeve which electrostatically holds non-magnetic one-component toner.

As described above, the gap between the image carrier and the developing roller can be kept uniform over the whole length in the longitudinal direction during the developing operation by pressing the positioning members on the image carrier by urging the developing roller at the first position. Moreover, the force pressing the positioning members on the image carrier is eased by the urging device. Therefore, randomness of rotation due to excessive pressure does not occur in the image carrier. Thus, density randomness and image blurring can be prevented by making the image density and the image carrier rotation uniform. Therefore, the picture quality can be improved. On the other hand, during non-developing operations, the developing device is urged in the second position in which the developing roller is separated from the image carrier, and the positioning members are separated from the image carrier. Therefore, distortion of the positioning members can be prevented. Thus, the randomness of density due to distortion of the positioning members which occurred in prior art is prevented. Therefore, the reliability of the apparatus can be improved. Also, when inserting and removing the developing device for the main body, the developing device is guided by a guiding device by which the developing device is separated from the image carrier. Thus, there is no risk of the developing device coming into contact with the image carrier. Therefore, the performance and reliability of the apparatus can be further improved.

What is claimed is:

1. An image forming apparatus having an image carrier, comprising:

means for providing a latent image on the image carrier;

a developing roller having a shaft for applying a toner to a latent image on the image carrier to develop the latent image by rotation thereof around the shaft;

a first gear mounted on the shaft for transferring a rotational force to the developing roller;

a casing for supporting the developing roller and the first gear;

a support member for supporting the casing such that the casing is movable between a first position where the developing roller closely faces the image carrier and a second position where the developing roller is in a non-contact relationship with the image carrier, the casing being detachably supported on the support member;

urging means for urging the support member toward the second position with a first force; and a second gear, meshed with the first gear when the casing is supported on the support member, for transferring the rotational force to the first gear and for urging the developing roller toward the first position with a second force greater than the first force.

2. The image forming apparatus of claim 1, wherein the second gear meshes with the first gear within the limits of a central angle of 0° to 45° taking a perpendicular line of the first gear as a reference when the second gear locates on the side from the perpendicular line to the image carrier.

3. The image forming apparatus of claim 1, wherein the second force is expressed by the following equation:

$$\text{second force} > [F \cdot \tan\beta \cdot \cos(\alpha+\beta)]$$

where F represents a tangential load of the first and second gears, $\alpha$ represents an angle formed by a line joining the centers of the first and second gears and a vertical line of the first gear, and $\beta$ represents a pressure angle of the first and second gears.

4. An image forming apparatus having an image carrier comprising:

means for providing a latent image on the image carrier;

a developing roller having a shaft for applying a toner to a latent image on the image carrier to develop the latent image by rotation thereof around the shaft;

a first gear mounted on the shaft for transferring a rotational force to the developing roller;

a casing for supporting the developing roller and the first gear;

a support member for supporting the casing such that the casing is movable between a first position where the developing roller closely faces the image carrier to form a gap therebetween, and a second position where the developing roller is remote from the image carrier, the casing being detachably supported on the support member;

a positioning member associated with the developing roller for making the gap uniform along the longitudinal direction of the developing roller when the support member locates the casing at the first position to allow the application of the developing agent to the image carrier;

urging means for urging the support member toward the second position with a first force;

a second gear, meshed with the first gear when the casing is supported on the support member, for transferring the rotational force to the first gear and for urging the developing roller toward the first position with a second force greater than the first force.

5. The image forming apparatus of claim 4, wherein the positioning member includes a pair of gap rollers mounted on the both ends of the shaft to contact with the surface of the image carrier.

6. The image forming apparatus of claim 4, wherein the second gear meshes with the first gear within the limits of a central angle of 0° to 45° taking a perpendicular line of the first gear as a reference when the second gear locates on the side from the perpendicular line to the image carrier.

7. The image forming apparatus of claim 4, wherein the second force is expressed by the following equation:

$$\text{second force} > [F \cdot \tan\beta \cdot \cos(\alpha+\beta)]$$

where F represents a tangential load of the first and second gears, $\alpha$ represents an angle formed by a line joining the centers of the first and second gears and a vertical line of the first gear, and $\beta$ represents a pressure angle of the first and second gears.

* * * * *